US005204484A

United States Patent [19]

Netto

[11] Patent Number: 5,204,484

[45] Date of Patent: Apr. 20, 1993

[54] SHARE ARRANGEMENT IN A PERCUSSION INSTRUMENT ATTACHED TO DRUM HEAD

[75] Inventor: Arthur W. Netto, Sao Paulo, Brazil

[73] Assignee: Weril Instrumentos Musicais Ltda., Sao Paulo, Brazil

[21] Appl. No.: 899,033

[22] Filed: Jun. 16, 1992

Related U.S. Application Data

[63] Continuation of Ser. No. 670,937, Mar. 18, 1991, abandoned.

[30] Foreign Application Priority Data

Jul. 4, 1990 [BR] Brazil ..... MU7001165

[51] Int. Cl.[5] ..... G10D 13/02

[52] U.S. Cl. ..... 84/415

[58] Field of Search ..... 84/415, 416, 417

[56] References Cited

U.S. PATENT DOCUMENTS

| | | | |
|---|---|---|---|
| 436,590 | 9/1890 | Theophel | 84/415 |
| 578,198 | 3/1897 | Boulanger | 84/415 |
| 2,604,001 | 1/1949 | Lewan | 84/417 |
| 3,186,289 | 6/1965 | Kester | 84/415 |
| 4,079,657 | 3/1978 | Sobreira | 84/411 R |
| 4,102,235 | 7/1978 | Le Masters | 84/411 R |
| 4,469,004 | 9/1984 | Kurosaki | 84/411 |
| 4,809,582 | 3/1989 | Chang | 84/414 |
| 4,928,566 | 5/1990 | Yanagisawa | 84/415 |

*Primary Examiner*—Michael L. Gellner
*Assistant Examiner*—Cassandra C. Spyrou
*Attorney, Agent, or Firm*—Jacobson, Price, Holman & Stern

[57] ABSTRACT

A snare drum has a metallic snare of stretched corrugated wires with its opposite ends fixed to the drum head by means of rivets at locations radially inwardly of the drum frame.

4 Claims, 2 Drawing Sheets

SHARE ARRANGEMENT IN A PERCUSSION INSTRUMENT ATTACHED TO DRUM HEAD

This is a Continuation of application Ser. No. 07/670,937, filed Mar. 18, 1991, which was abandoned upon the filing hereof.

BACKGROUND OF THE INVENTION

The present invention relates to a snare arrangement in a percussion instrument, such as a drum, in which a metallic snare or chime mat is fixed and protected under the leather or plastic head of the instrument, thus eliminating the problems of wear to the components of the instrument which maintain a direct contact with the frame and providing improved performance.

It is known in percussion instruments, for a chime mat or snare to be placed over the head and be fixed by means of screws to the frame at the side of the instrument.

With constant use of the instrument, the head becomes jeopardized, and the structure of the instrument also becomes damaged by the continuous use of the clamp screws.

SUMMARY OF THE INVENTION

In a percussion instrument according to the invention, the leather or like head has one or more metallic mats or snares with corrugated wires fixed thereto by means of rivets or other attachment means. The snare, in stretched form, may be positioned substantially diametrically.

Thus, there is no damage to the head with constant use of the instrument, and in addition, the invention provides an improved vibration and sound.

DESCRIPTION OF PREFERRED EMBODIMENT

Figure 1:
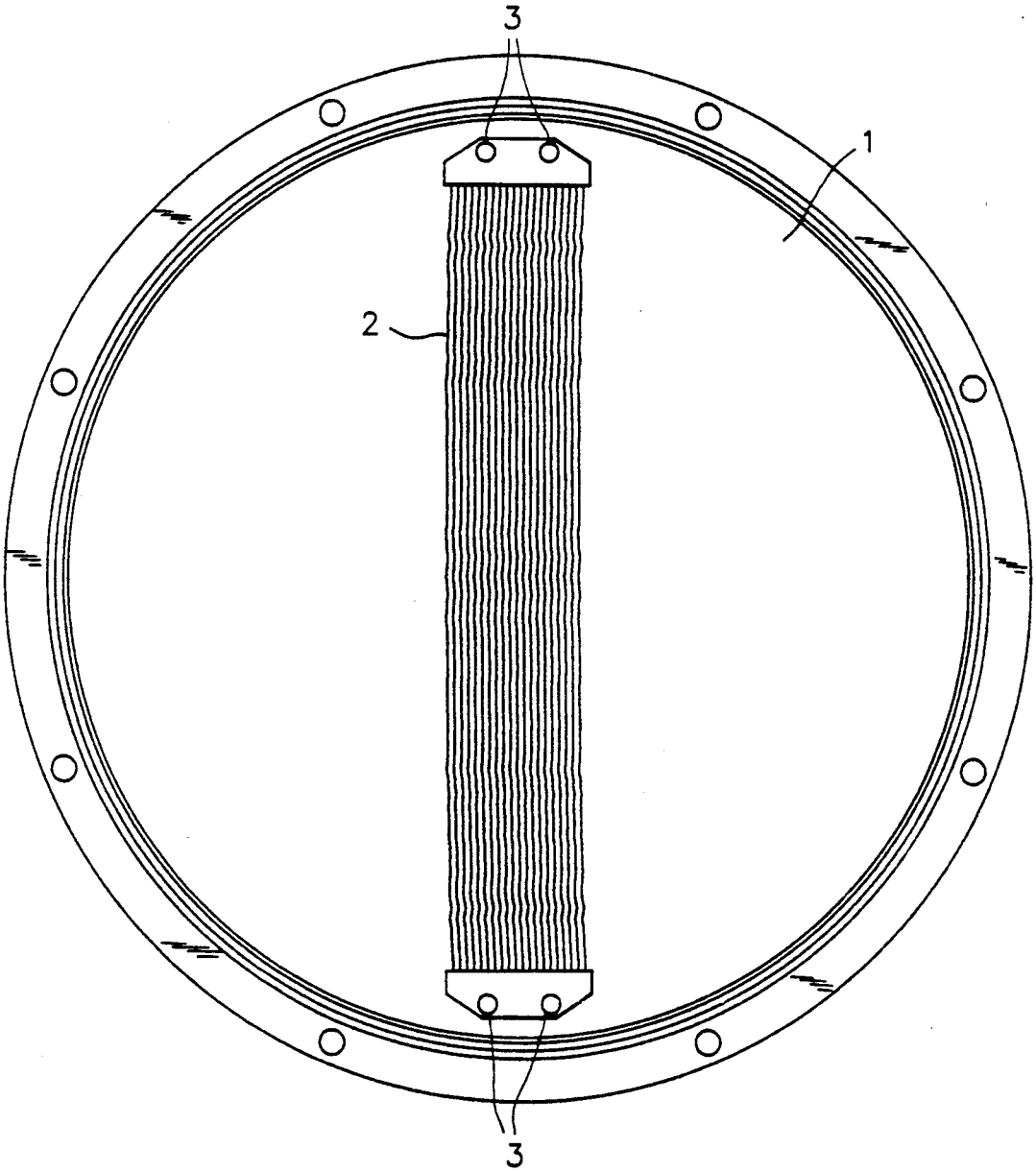
FIG. 1 is a plan view of an instrument according to the invention.
Figure 2:
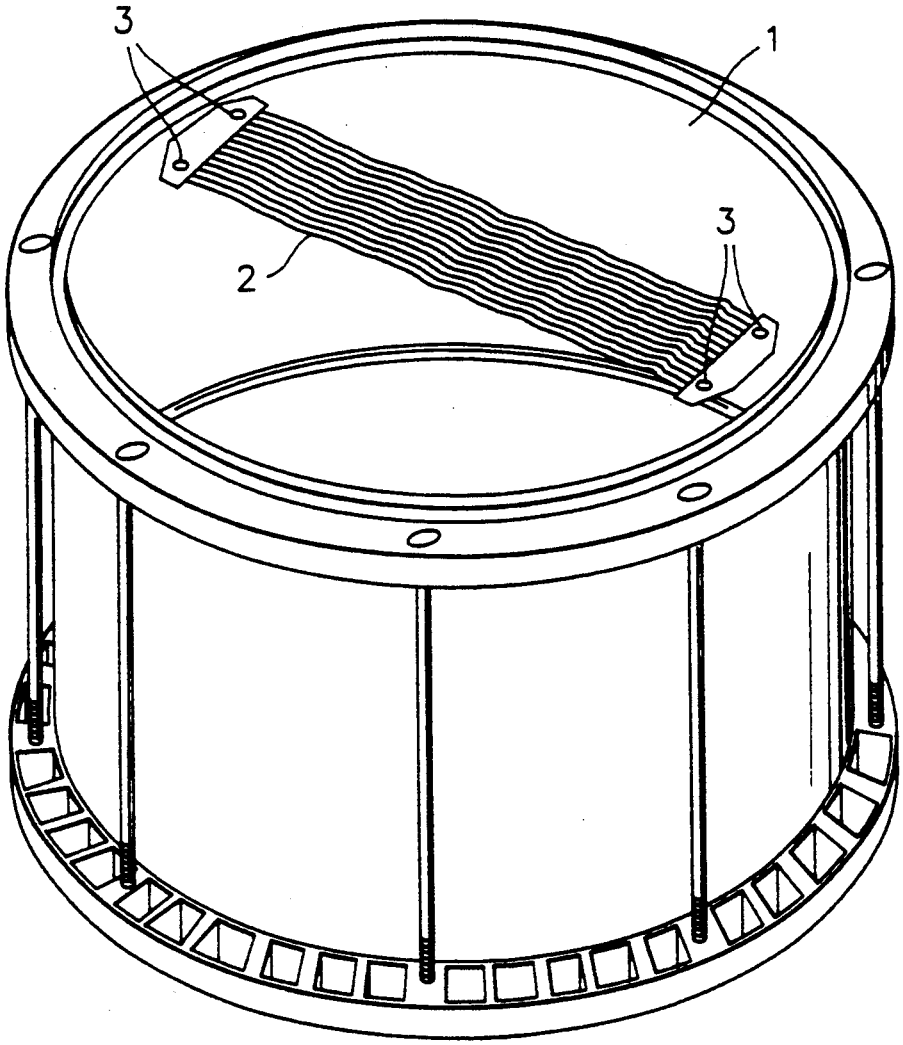
FIG. 2 is a perspective view of the instrument.

The drawings show a drum whose leather or plastic head (1) has a metallic snare or chime mat (2) fixed thereto, for example, by means of rivets (3). The snare is stretched and internally positioned. The head of the drum is secured to a surrounding frame.

The present invention is characterized by being of an easy execution and low cost in terms of its industrial viability, but together with the requirements of robustness, safety and practicality, providing to the consumers an additional option in similar markets.

The present invention deals, therefore, with a new conception in the attachment of chime mats in percussion instruments, whose technical, constructive and functional characteristics are entirely different to those in the prior art.

I claim:

1. A percussion instrument comprising a head mounted in a circular frame, a metallic snare of substantially parallel corrugated wires, and attachment means securing opposite ends of the snare to the head of the instrument at locations radially inwardly of the frame and with the wires stretched.

2. A percussion instrument according to claim 1, wherein the snare is attached to the head internally of the instrument.

3. A percussion instrument according to claim 1, wherein the attachment means comprises rivets.

4. A percussion instrument according to claim 1, wherein the snare is attached substantially diametrically of the head.

* * * * *